United States Patent [19]

Telfer

[11] Patent Number: 4,599,989

[45] Date of Patent: Jul. 15, 1986

[54] BLACK HOLE FIRE IRONS

[76] Inventor: G. Ronald Telfer, 9 Burnamthorpe Crescent, Islington, Ontario M9A 1G5, Canada

[21] Appl. No.: 672,954

[22] Filed: Nov. 19, 1984

[51] Int. Cl.[4] ..... F23H 13/00

[52] U.S. Cl. ..... 126/164; 126/298; D23/138.4

[58] Field of Search ..... 126/152 A, 152 B, 120, 126/121, 165, 164, 298, 336, 152 R; 211/60 R; D23/138.2, 138.3, 138.4, 138.5

[56] References Cited

U.S. PATENT DOCUMENTS 2,523,200 9/1950 Durst, Jr. ..... 126/30

4,069,808 1/1978 Cranberg ..... 126/164

4,257,338 3/1981 Chasek ..... 126/164

*Primary Examiner*—James C. Yeung

*Attorney, Agent, or Firm*—Sim & McBurney

[57] ABSTRACT

A fire iron set comprises two identical members which are horizontally spaced apart one from the other. Each includes a base member having an upwardly-curved end and an upright member joined to the base member. A downwardly-depending arm is rigidly connected to a sleeve slidably received on the upright member. A stop pin extends through openings in the upright member at selected heights in the upright member to provide a variably predetermined fixed location.

5 Claims, 4 Drawing Figures

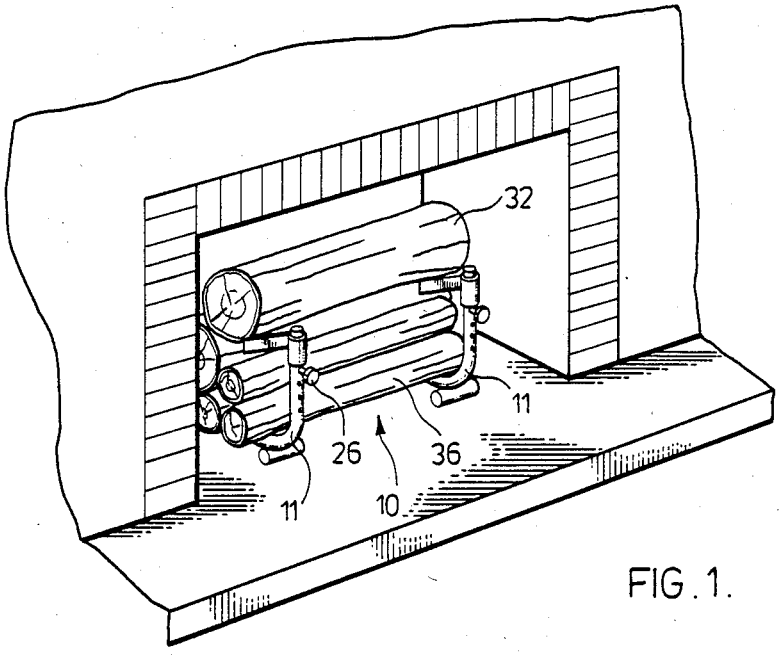
FIG. 1.
FIG. 2.
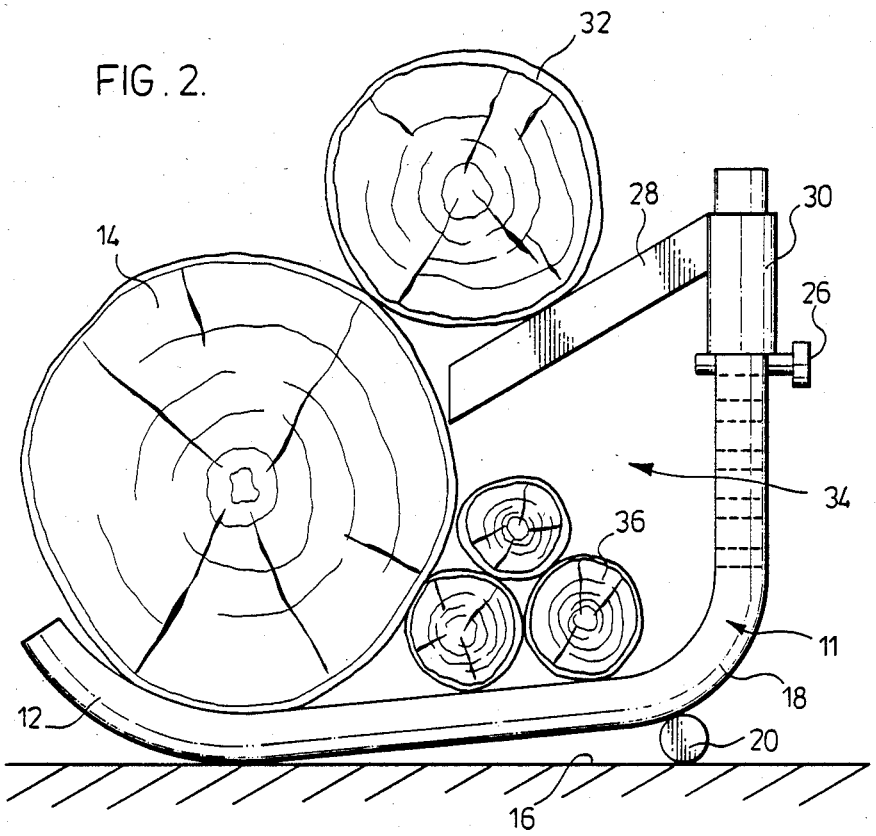

BLACK HOLE FIRE IRONS

FIELD OF INVENTION

The present invention relates to fire irons and, in particular, to fire irons which are designed to hold logs in a manner which achieves controlled combustion.

BACKGROUND TO THE INVENTION

One problem which arises with known domestic fire grates in the combustion of logs is that a substantial fraction of the radiant heat from the combustion of the logs is directed towards the walls of the fireplace in which the fireplace is located and not into the area intended to be heated by the combusting logs.

It has previously been suggested in U.S. Pat. No. 4,069,808 to provide a C-shaped configuration of logs opening into the area to be heated, so that thermal radiation to that area is maximized, and an apparatus for holding such logs.

The apparatus described in this prior patent comprises an elongate device having spaced apart elongate parallel arms, one of which terminates in upwardly-directed parallel arms, and joined by spaced apart parallel bowed arms, which form a cradle for the logs. On each of the upwardly directed arms is slidably located an inwardly-directed horizontal arm extending parallel to the one elongate arm which has rotatably mounted to its free end a further arm extending perpendicular to the horizontal arm. The weight of the further arm bends the horizontal arms slightly about its sliding engagement with the upwardly-directed arm to lock the same in a desired location.

The prior art apparatus is cumbersome, provides an easily-dislodged manner of location of the horizontal arm with respect to the upwardly-directed arms, and is expensive to manufacture.

SUMMARY OF INVENTION

The present invention overcomes the problems of the prior art structure by providing a pair of identical fire iron members which may be spaced apart any convenient distance to accommodate any size of fireplace or log length, which the prior art is not able to achieve. Further, a rigid arm is connected to a sleeve slidably located with respect to an upright arm and extends downwardly, thereby avoiding the expense of two arms and a pivotal mounting between them. In addition, the sleeve which holds the depending arm is positively prevented from sliding to a lower than intended location by a stop pin which is intended to engage the lower end of the sleeve and is received in one of a plurality of openings located in the upright arm. Such positive undislodgeable positioning is not achievable in the prior art structure.

In accordance with the present invention, therefore, there is provided a fire iron set for burning logs in a fireplace, comprising at least two identical laterally-spaced free-standing separate fire iron members, each of the fire iron members including a generally horizontal portion having an integrally-formed upwardly-curved portion at one end thereof and an integrally-formed generally upright portion at the other end thereof, the upright portion having a sleeve member slidably received thereon and variable location stop means for preventing downward sliding movement of the sleeve member beyond a preselected one of a plurality of vertical positions on the upright portion, the sleeve member having an angularly-downwardly projecting rigid arm member integrally formed therewith and extending in the plane of the fire iron member towards the free end of the upwardly-curved portion.

This arrangement enables logs to be positioned on the fire irons to establish an efficient heat source, which generates heat which is directed into the room.

BRIEF DESCRIPTION OF DRAWINGS

FIG. 1 is a perspective view of a fireplace a fire iron set constructed in accordance with one embodiment of the invention and having logs mounted thereon;

FIG. 2 is a side elevational view of the fire iron set of FIG. 1;

DESCRIPTION OF THE PREFERRED EMBODIMENT

Figure 4:
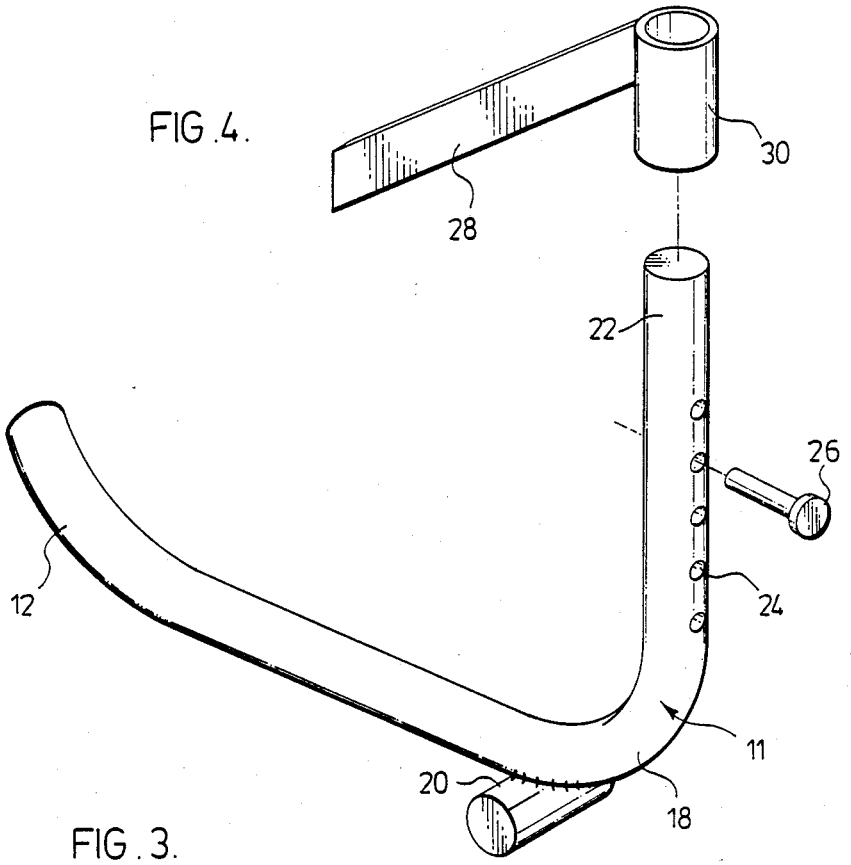
FIG. 4 is a respective exploded view of a fire iron unit of the fire iron set of FIG. 1

Referring to the drawings, the fire grate illustrated comprises a free-standing fire iron set 10 of two or more identical fire iron units 11, depending on the width of the fireplace and wood length. Each unit is curved at one end 12 to support a large diameter log 14, for example, a maximum of 9 inches in diameter with that end resting on the support surface 16.

The other end 18 is bent upwardly, supported by a welded cross piece 20 of channel iron or the like resting on the support surface 16, and, after the bend, extends as a vertical arm 22 and at an angle of 90 degrees to the horizontal plane.

The vertical arm 22 has a number of equally-spaced support holes 24 of any convenient diameter extending in the same direction as the main body of the fire iron 10. For example, five holes 24 of 3/8 inch diameter may be spaced apart 1 inch. By means of a support pin 26 extending through one of the holes 24, a downwardly angularly depending support arm 28 rigidly connected to a sleeve 30 slidably received on the vertical arm 22 can be adjusted to any one of a number of positions, to support a further large diameter log 32, for example of maximum six inches in diameter, in a suitable position resting against log 14, positioned in the main support at the curved end 12. The log 32 usually has a smaller diameter than the log 14. The logs 14 and 32 stabilize one another and are held in place by gravitational forces.

The logs 14 and 32 act as the walls of a combustion chamber 34. Other small diameter logs 36, for example, up to 2½ inches in diameter, are introduced into the remaining space between the vertical support end 22 and the other two logs 14 and 32.

The small diameter logs 36 are ignited. The resulting fire causes the smaller pieces 36 to burn and the other two larger logs 14 and 32 to glow on their surface, thus creating an efficient heat source in the cavity 34, and maximizing the radiated heat in one direction from the cavity 34 into the room in which the fireplace is located. The heat generated is efficiently directed into the room the fire is intended to heat, rather than being lost up the chimney.

The small diameter logs 36 are replaced as they burn. As the larger logs 14 and 32 gradually burn away themselves, they tend to become fuel rather than reflecting walls and in time are replaced, the cycle repeating itself.

Figure 3:
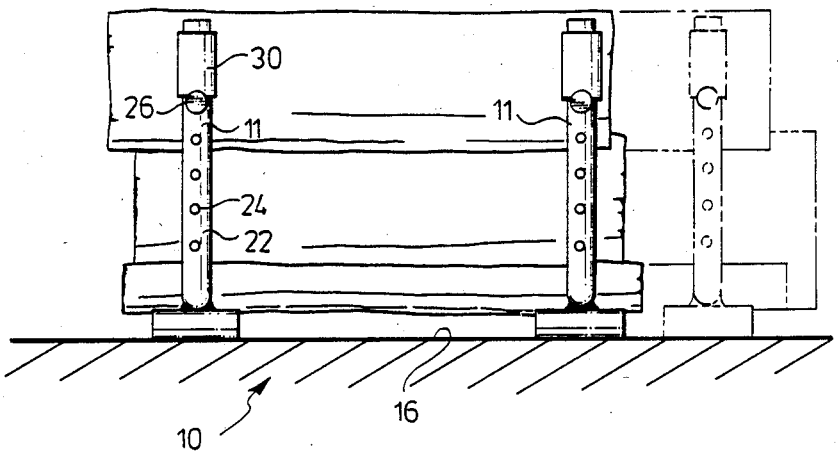
FIG. 3 is a front elevational view of the fire iron set of FIG. 1.

As may be seen from FIG. 3, by providing a pair of independent fire iron units 11, any convenient width of logs may be accommodated for burning. The provision of the combination of rigid arm 28 and sleeve 30 which may be positioned in a number of vertical locations provides flexibility in log positioning while providing a stable structure.

SUMMARY OF DISCLOSURE

In summary of this disclosure, the present invention provides an improved fire iron set which is superior to the prior art structures. Modifications are possible within the scope of the invention.

What I claim is:

1. A fire iron set for burning logs in a fireplace, comprising:

at least two identical laterally-spaced free-standing separate fire iron members, each of said fire iron members including a generally horizontal portion having an integrally-formed upwardly-curved portion at one end thereof and an integrally-formed generally upright portion at the other end thereof, said upright portion having a sleeve member slidably received therein and variable location stop means for preventing downward sliding movement of said sleeve member beyond a preselected one of a plurality of vertical positions on the upright portion, said sleeve memnber having a rigid arm integrally formed therewith and projecting angularly downwardly in the plane of the fire iron member towards the free end of the upwardly-curved portion.

2. The fire iron set of claim 1 wherein said generally horizontal portion extends gently upwardly from said one end to said other end thereof and including spacer means mounted at said other end to permit said fire iron members to rest on a horizontal surface.

3. The fire iron set of claim 2 wherein said stop means comprises a plurality of horizontal openings extending through the upright portion and pin means located in a desired one of said holes and projecting therefrom in such manner as to engage the lower end of said sleeve.

4. The fire iron set of claim 3 wherein said curved portion extends through an arcuate angle of about 55° and said rigid arm member subtends an angle of about 60° to the vertical.

5. The fire iron set of claim 1, in combination with a first, second and third set of logs, said sets each comprising at least one log longitudinally oriented with respect to one another in a generally C-shaped geometric configuration with the first, second and third set of logs respectively providing the upper, lower and rear legs of the C-shaped geometric configuration, the second set of logs being located in engagement with the curved portion, the first set of logs being located in engagement with the depending arm and the second set, the third set being located in engagement with the generally horizontal portion beneath the depending arm and in engagement with the second set, thereby to define an elongated combustion slot having an axis substantially parallel to the axis of the log sets.

* * * * *